US006935665B2

(12) United States Patent
Jones et al.

(10) Patent No.: US 6,935,665 B2
(45) Date of Patent: Aug. 30, 2005

(54) APPARATUS AND METHOD FOR SPOOLING OF WIRE CORES

(75) Inventors: Samuel E. Jones, Carthage, MO (US); Craig V. Millett, Granby, MO (US)

(73) Assignee: L & P Property Management Co., South Gate, CA (US)

( * ) Notice: Subject to any disclaimer, the term of this patent is extended or adjusted under 35 U.S.C. 154(b) by 81 days.

(21) Appl. No.: 10/113,437

(22) Filed: Mar. 29, 2002

(65) Prior Publication Data

US 2003/0184105 A1 Oct. 2, 2003

(51) Int. Cl.[7] ..... B66C 1/00
(52) U.S. Cl. ..... 294/97; 242/574.1; 242/574.4
(58) Field of Search ..... 294/63.2, 67.31, 294/67.1, 93, 94, 95, 97; 414/684, 910, 911; 242/574.1, 574.4; 100/5, 159, 163 R, 168, 169, 211, 916

(56) References Cited

U.S. PATENT DOCUMENTS

| | | | | | |
|---|---|---|---|---|---|
| 1,169,004 | A | * | 1/1916 | Cargin | 294/97 |
| 2,634,156 | A | * | 4/1953 | Crimmel | 294/95 |
| 3,033,605 | A | * | 5/1962 | Morrow | 294/97 |
| 3,088,769 | A | * | 5/1963 | Richardson | 294/97 |
| 3,129,658 | A | | 4/1964 | Valente | 100/218 |
| 3,548,739 | A | | 12/1970 | Glasson | 100/7 |
| 3,583,311 | A | | 6/1971 | Hill | 100/7 |
| 3,633,492 | A | | 1/1972 | Gilvar | 100/3 |
| 3,675,568 | A | | 7/1972 | Martelee | 100/7 |
| 3,678,845 | A | | 7/1972 | Francois et al. | 100/4 |
| 3,729,092 | A | * | 4/1973 | Marcell | 206/303 |
| 3,788,210 | A | | 1/1974 | Lingemann | 100/7 |
| 3,842,728 | A | | 10/1974 | Elineau | 100/7 |
| 3,908,712 | A | | 9/1975 | Paletzki | 140/1 |
| 3,921,510 | A | | 11/1975 | Glasson | 100/7 |
| 3,974,761 | A | | 8/1976 | Hill | 100/7 |
| 4,020,755 | A | | 5/1977 | Böhlmark | 100/12 |
| 4,024,805 | A | | 5/1977 | Glasson | 100/12 |
| 4,301,720 | A | | 11/1981 | Elineau | 100/12 |
| 4,460,210 | A | * | 7/1984 | Miechur | 294/97 |

* cited by examiner

*Primary Examiner*—Eileen D. Lillis
*Assistant Examiner*—Michael Lowe
(74) *Attorney, Agent, or Firm*—Dennis J. M. Donahue, III; Grant D. Kang; Husch & Eppenberger, LLC

(57) ABSTRACT

A wire core spool including a central axial member, a plurality of expansion swing arms, each having a proximal end and a distal end, the proximal ends pivotally attached to the central axial member, a plurality of contact members, each having a top and a bottom end, each of said contact members being pivotally attached to each of the distal ends of each of at least one of the expansion arms, a plurality of base members each attached to one of the bottom ends of said contact members, said base members disposed to support a bottom surface of a wire core, and at least one stand section fixedly attached to the bottom of the central axial element, the stand sections and base members being in spaced relation sufficient to allow passage of a binding wire therebetween, and such that said base members are disposed to rest on top of the stand sections.

20 Claims, 12 Drawing Sheets

APPARATUS AND METHOD FOR SPOOLING OF WIRE CORES

CROSS-REFERENCE TO RELATED APPLICATIONS

The subject matter of the present application is related to U.S. application Ser. No. 10/113,533, filed on Mar.29, 2002, which has issued as U.S. Pat. No. 6,701,831.

STATEMENT REGARDING FEDERALLY SPONSORED RESEARCH OR DEVELOPMENT

Not applicable.

BACKGROUND OF THE INVENTION

1. Field of the Invention

This invention relates to the automated packaging of transportable spools of wire, most typically heavier gauges of wire such as bale binding wire.

2. Related Art

Wire is typically packaged and transported in spools. More precisely, lengths of wire are wound in spirals which form a cylinder as the wire accumulates. A central, axial empty space is also cylindrical so that the finished volume of wound wire is toroidal in shape. This packaging shape is generally maintained by radial binding straps or wires which pass through the central axial space and wrap around a cross section of the volume of wire to be bound in a radial loop which will prevent the wire from unwinding.

When commercial volumes of heavy gauge wire are spooled, the weight of such volumes of wire become an issue in handling, packaging and transporting them. For example, typical volumes of bulk material baling wire are too heavy to be moved, stored or transported without the use of machinery such as fork trucks. These bound toroids of wire, conventionally referred to as "cores," are difficult to handle by fork truck and may be damaged by fork truck handling, unless they are placed on a handling aide such as a pallet. Handling wire cores by pallet still necessitates placing the core on the pallet to begin with, and later removing it from the pallet for placement in a position for its ultimate use.

There is a need in the industry for increasing the speed, ease, efficiency and economy with which material like wire is spooled.

Apparatuses and methods for winding and binding wire into cores are known. See, for example, U.S. Pat. No. 3,129,658 to Valente; U.S. Pat. No. 3,908,712 to Paletzki; U.S. Pat. No. 3,583,311 to Hill et al.; U.S. Pat. No. 3,974,761 to Hill. Various wire binders are known, See U.S. Pat. No. 3,548,739 to Glasson; U.S. Pat. No. 3,675,568 to Martelee; U.S. Pat. No. 3,921,510 to Glasson; U.S. Pat. No. 4,024,805 to Glasson; U.S. Pat. No. 3,678,845 to Francois; U.S. Pat. No. 3,842,728 to Elineau; and U.S. Pat. No. 4,301,720 to Elineau. Various core handling devices have also been developed. See, U.S. Pat. No. 3,633,492 to Gilvar; U.S. Pat. No. 3,788,210 to Lingemann; and U.S. Pat. No. 4,020,755 to Bohlmark. None of these systems, however, solve the problem of handling and transporting the heavy wire cores output by these and other prior art machines.

SUMMARY OF THE INVENTION

The present invention is a collapsible carrying spool specifically designed to facilitate the handling and transportation of the wire cores output by an apparatus and method of wire core binding that produces a wire core integrated with the spool.

The wire core binding apparatus receives an uncompressed, unbound, loose spiral of wire wound onto one of the novel, collapsible carrying spools of the present invention. A conveyor belt extends into a binding station where the loose wire spiral, on the spool, is deposited. Once in the binding station, the wire spiral is compressed by a compressor. While compression is still being applied, binding wire guide tracks close around the wire core and guide binding wire radially around the wire core. The binding wire is tightened, tied and released according to known techniques. In a preferred embodiment of the present invention there are four binding wire guide tracks. Two binding wire tying heads simultaneously guide, tighten and bind two radial binding wires through two of the guide tracks. Thereafter, the tying heads rotate 90° where the other two guide tracks are used to guide, tighten and tie a third and fourth binding wire around the wire core. The wire guide tracks are then removed from engagement with the wire core. Thereafter, compression is released on the wire core, leaving it to remain compressed by the restraining binding wires. Finally, the now bound, compressed wire core, still resting on its integrated collapsible carrying spool, is received by an extending exit conveyor by which it is removed from the binding station.

The novel spool of the present invention handles transportation of the wire core. The spool has base members and stand members whose vertical separation allows insertion of fork truck forks. Another novel aspect of the spool is that it has expandable and retractable contact members which work in cooperation with a central lift facilitating member. The cooperation of the contact members and lift facilitating members is such that the contact members expand to hold the wire core securely in place when the lifting member is lifted by an outside device such as a fork truck or an overhead hook. When lifting traction is released from the lifting facilitating member, the contact members release their radial expansion contact with the wire core so that the core may be easily removed from the spool.

Further features and advantages of the present invention, as well as the structure and operation of various embodiments of the present invention, are described in detail below with reference to the accompanying drawings.

DESCRIPTION OF THE PREFERRED EMBODIMENTS

Figure 1:
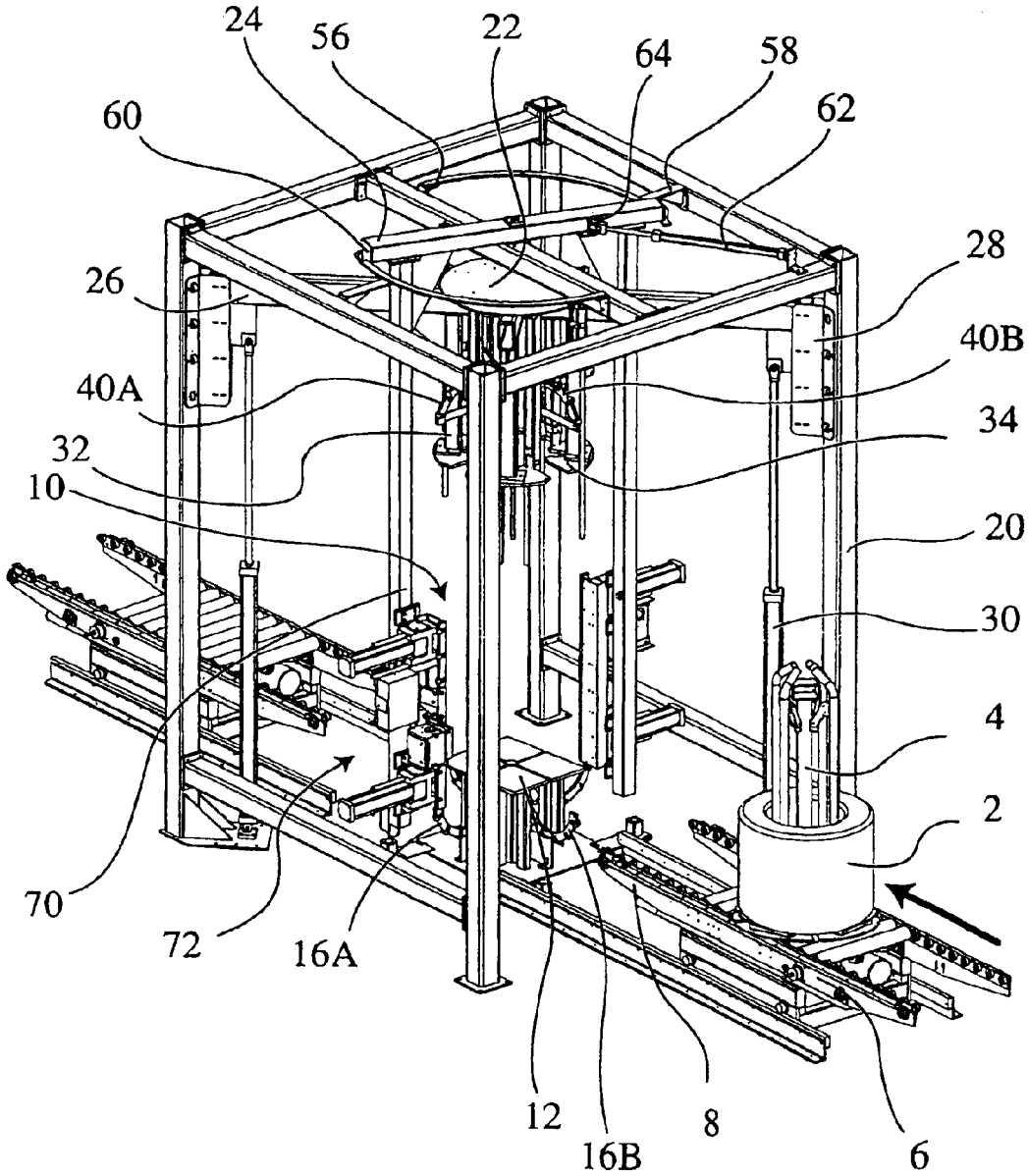
FIG. 1 is a perspective view of the wire core binding apparatus with the compressor and guide tracks elevated.

Referring to the accompanying drawings in which like reference numbers indicate like elements, FIG. 1 is a perspective view of the automatic wire core binder with integrated spool of the present invention. Unbound wire core, 2, having been previously wound onto wire core spool, 4, is carried along entry conveyor, 6, towards the apparatus. Entry conveyor, 6, incorporates extending arms, 8, which, upon arrival thereon of the wire core, 2, and spool, 4, extend beyond conveyor assembly, 6, to carry the wire core, 2, and spool, 4, into the baling station, 10.

Figure 2:
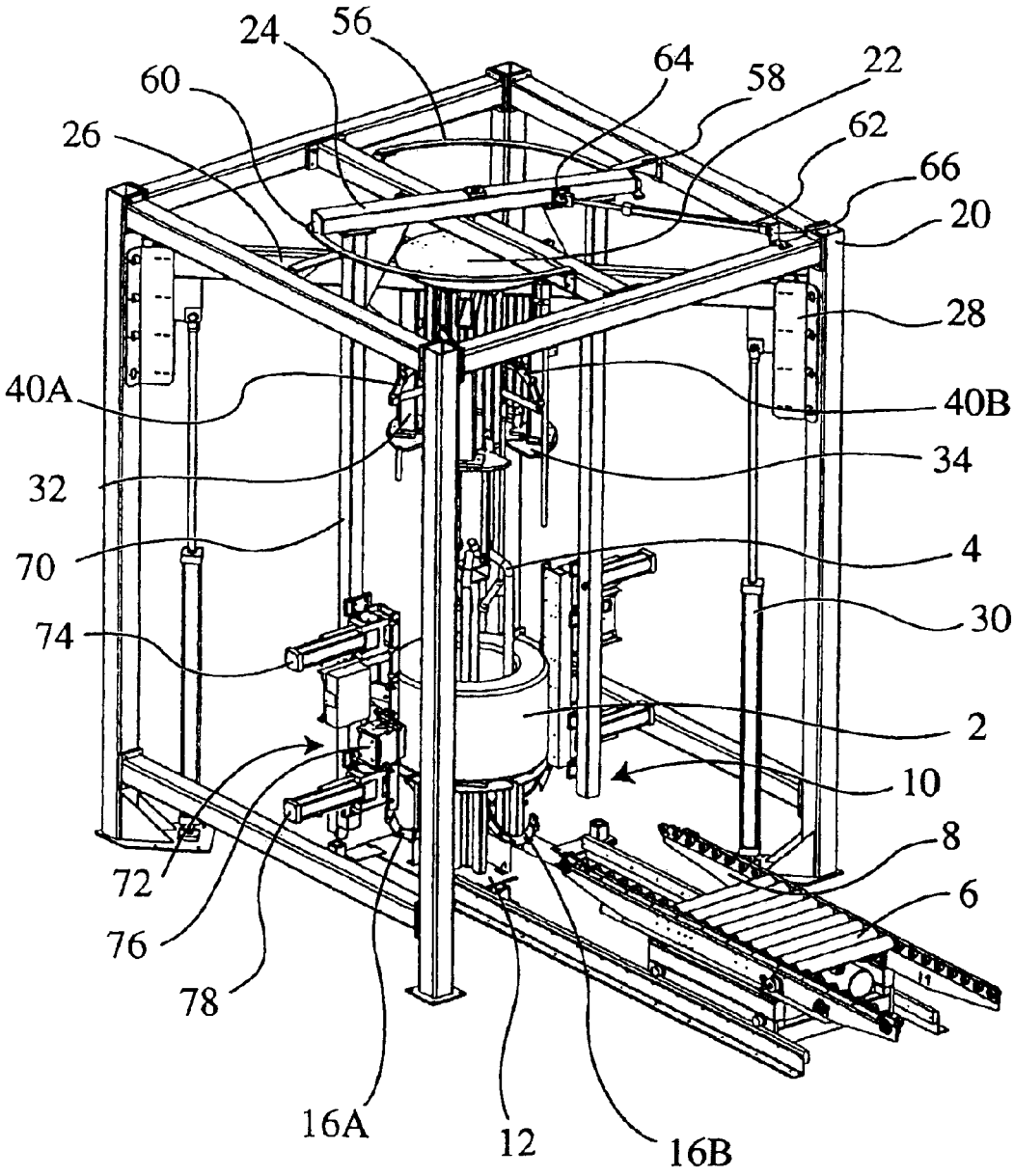
FIG. 2 is a perspective view of the wire core disposed within the binding station with the compressor and guide tracks elevated.
Figure 3:
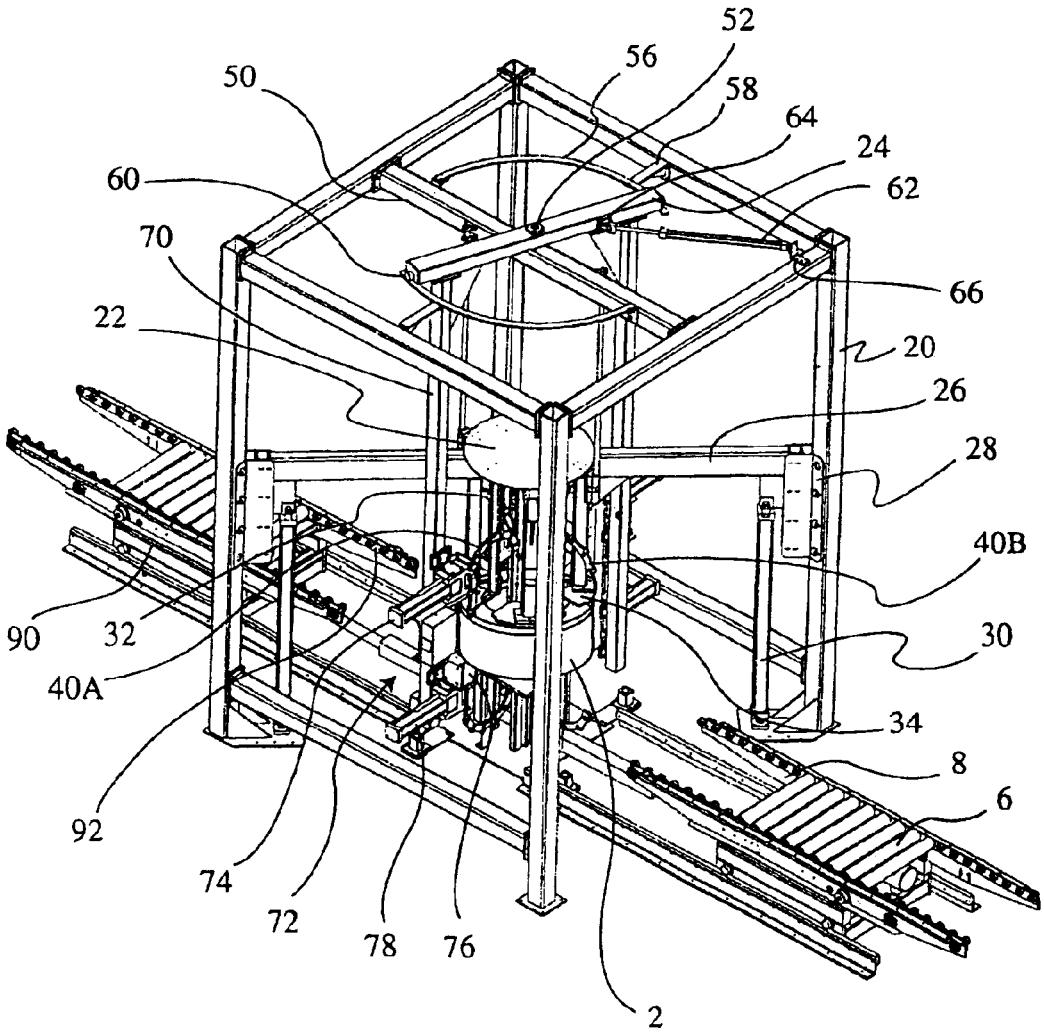
FIG. 3 is a perspective view of the wire core binding apparatus with the compressor and guide tracks engaged with the wire core.

In the baling station, 10, the wire core, 2, and carrier spool, 4, are placed on table, 12, by the extending arms, 8, of the conveyor belt, 6. The extending arms thereafter retract, leaving the core, 2, and the carrier spool, 4, on table, 12, as in FIGS. 2, 3 and 4.

Figure 6:
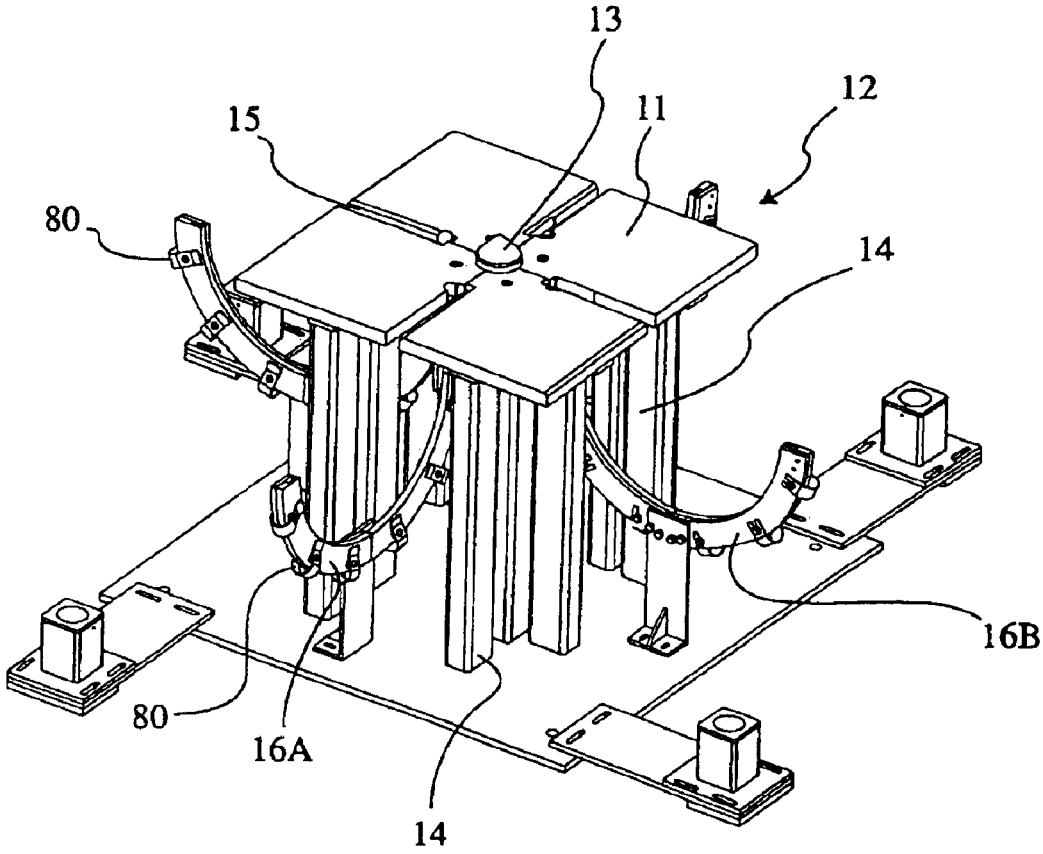
FIG. 6 is a perspective view of the wire core binding apparatus binding table.

Table, 12, is comprised of separate components, preferably four in number as shown in FIG. 6. Each component is comprised of a table top section, 11, and at least one leg, 14. These four table top sections are disposed on a level plane, adjacent to one another but with spacing between them. Accordingly, four gaps, 15, are left between the table top quadrants 11. These gaps are a path for the passage of a binding wire through the table top and between the table top quadrants.

Spool, 4, also has gaps, preferably four, that allow binding wire to pass through them. The spool is described more fully below. The spool gaps align with the table gaps. The table 12 and spool 4 will cooperatively receive the components that will descend through the center of the core, 2, during the binding and compression operation described more fully below.

To align the table 12 and spool 4, the table top has a locator pin, 13. The depicted embodiment has a central conical pin, 13, for properly centering the core spool on the table. Upon receipt of wire core, 2, and carrier spool, 4, the locator pin helps to assure the proper position of carrier spool, 4, so that its gaps align with the table gaps 15.

The table legs, 14, have lower guide track sections, 16A and 16B, as seen in FIGS. 1 and 6.

At least two techniques may be used to rotationally align the spool gaps with the table gaps, 15. One method uses at least one locator pin offset from the center of the table (not shown). Preferrably a plurality of pins on the table top are received by holes in the spool bottom which are located in a position corresponding to proper gap alignment. The pins may be in the spool and holes in the table. Alternatively, the pins may retract and extend by known means, may be spring biased to extend, or may be fixed.

Figure 12:
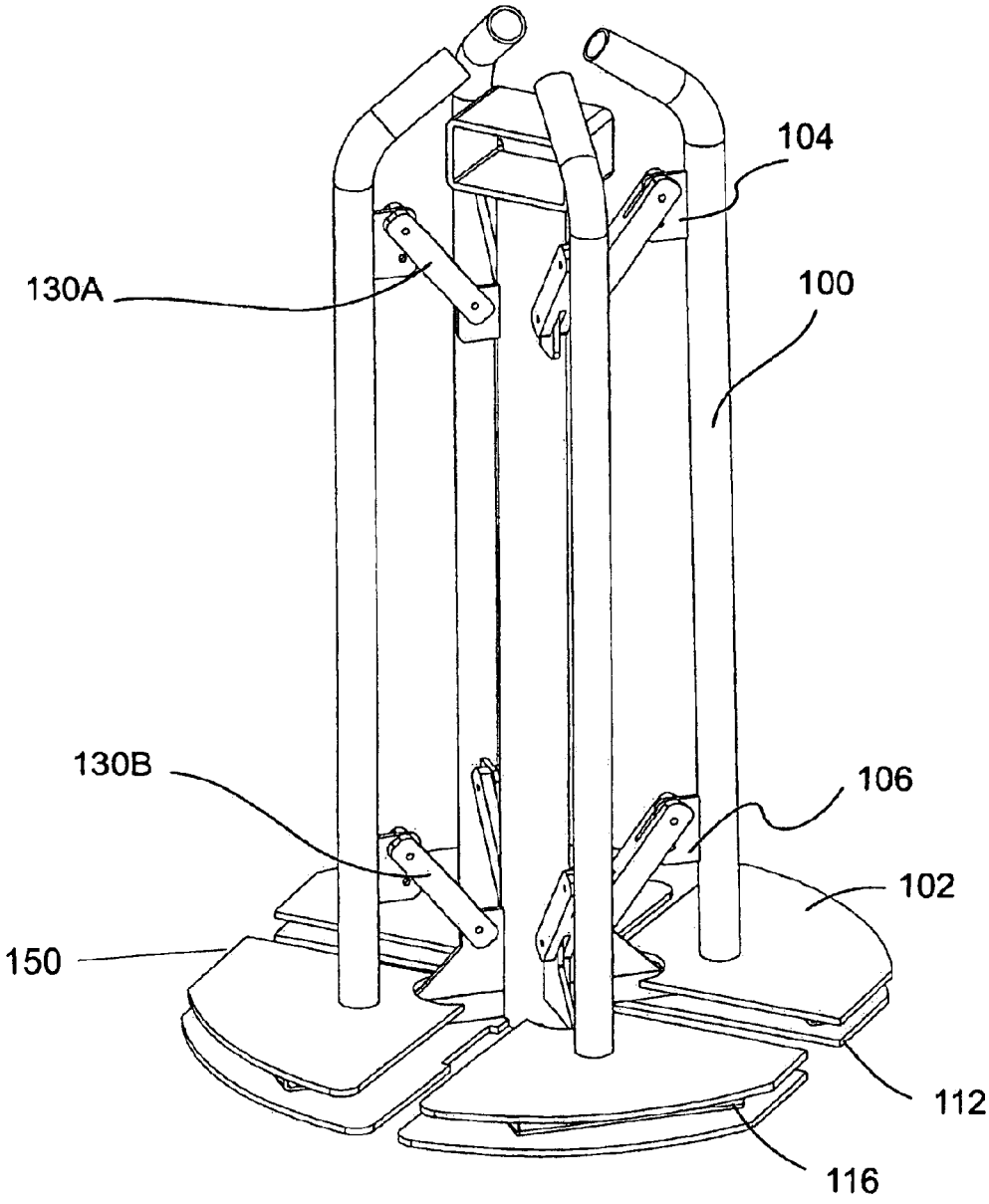
FIG. 12 is a perspective view of the collapsible spool with flat sides for alignment.
Figure 13:
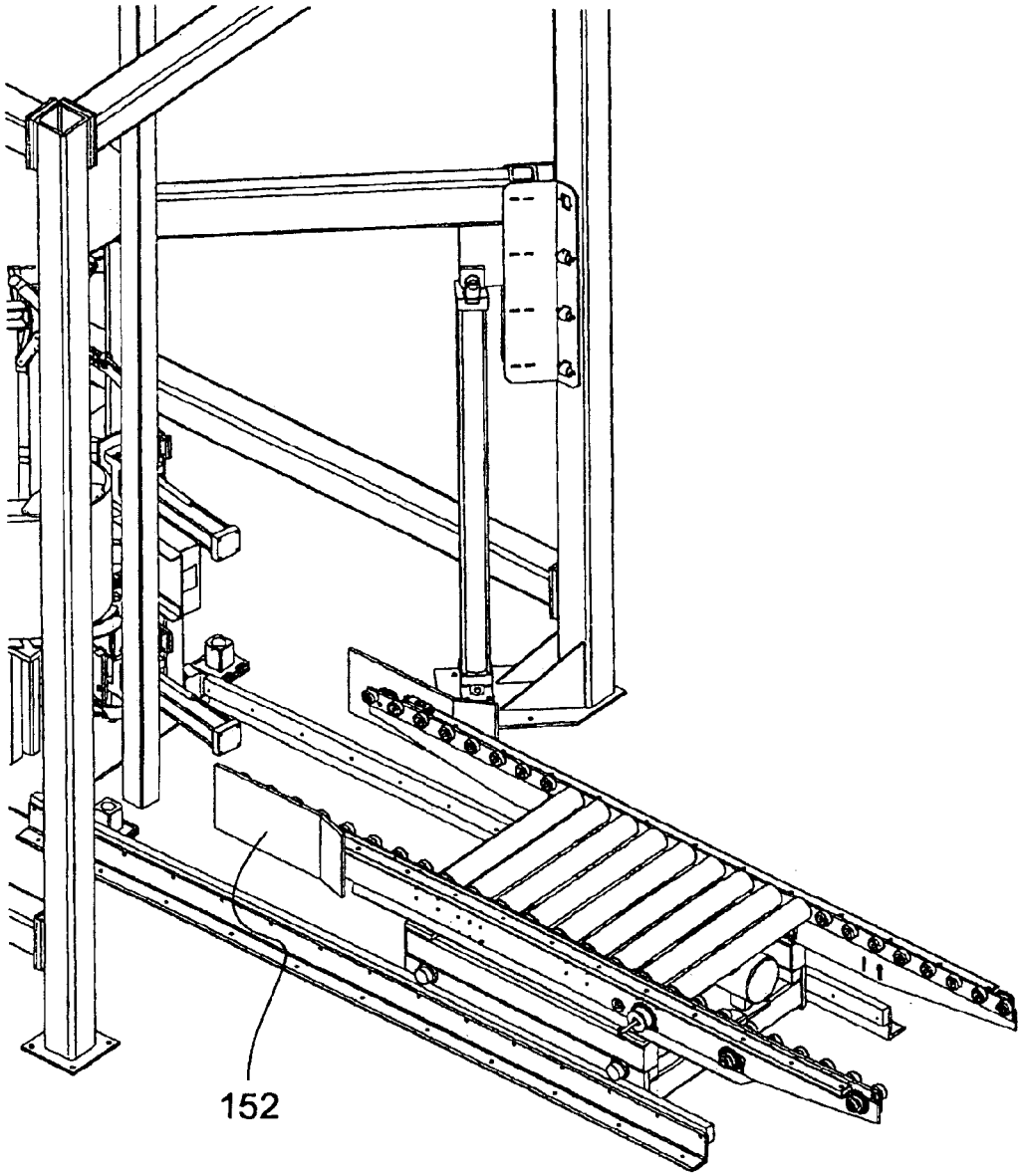
FIG. 13 is a close up view of the entry conveyor with side walls for alignment.

A second gap alignment technique is to configure the spool with straight edges on its bottom 150 in FIG. 12. The spool bottom is then dimensioned to slide down the entry conveyor with its straight edges in close sliding cooperation with sidewalls, 152 in FIG. 13, mounted on the conveyor (not shown). This configuration aligns the gaps parallel to the spool's line of travel down the conveyor. Gaps perpendicular to the long axis of the conveyor belt are then aligned by the conveyor extension arms. The arms are indexed to accurately place the spool on the table. Preferably the indexing is executed by a "cyclo" index box, in a known manner.

Disposed around the baling station is support frame, 20, as seen in FIGS. 1–4. Support frame, 20, is in a known, pre-determined spacing and alignment around table, 12. Preferably, both table, 12, and frame, 20, are fixedly attached to a base plate or floor. Generally, support frame, 20, secures operational component assemblies, which are compressor, 22, and rotating tying head top bracket, 24.

Compressor, 22, is slidably attached to two diagonally opposed vertical beams of frame, 20. Compressor boom, 26, is fixedly attached at either end to slide guides, 28 on frame 20. Compressor elevators, 30, lower the compressor, 22, to compress a wire core, as in FIGS. 2, 3 and 4, and raise the compressor, 22, after the wire core has been bound. The raised position is shown in FIG. 1. Compressor elevators, 30, are attached to compressor boom, 26, and to frame, 20, although they may alternatively be attached to the floor. Compressor elevators, 30, may provide lift by any number of equivalent means including pneumatic power, hydraulic power or mechanical means.

Compressor, 22, includes compression arms, 32, and compression face plates, 34. Compression plates, 34, contact the wire core on its top surface and transfer the compressing force to the wire core, 2. Compression arms, 32, extend down vertically from where they are fixedly attached to compression boom, 26. Solid compression arms, 32, are of a pre-configured length in order to bring compression faces, 34, into contact with wire core, 2. Alternatively, they may be made variable in length by any conventional mechanical means, in order to accommodate wire cores of varying heights.

Figure 5:
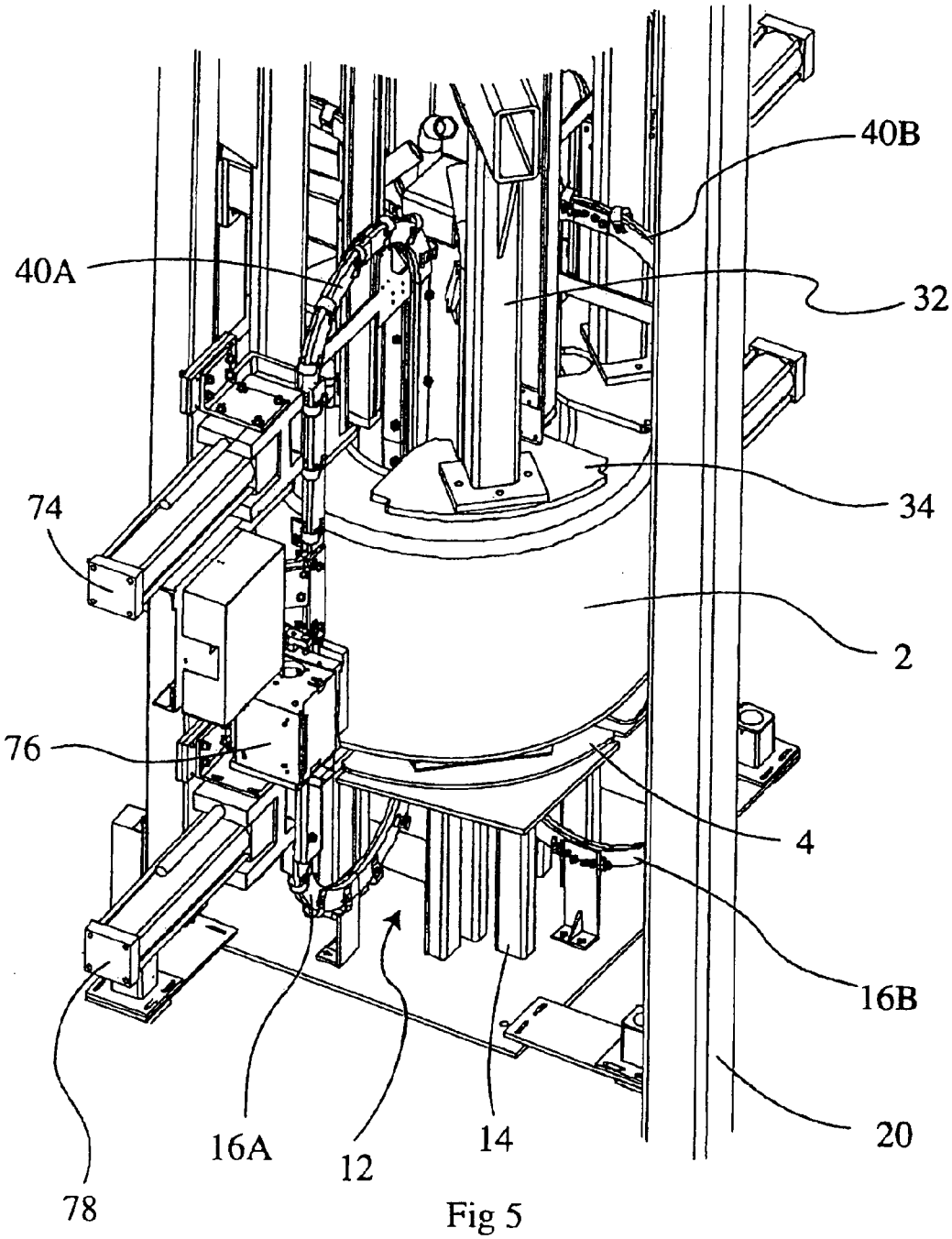
FIG. 5 is a closer perspective view of the wire core binding apparatus with the guide tracks and compressor engaged.

Also fixedly attached to compressor, 22, are four wire guide track upper sections, 40A and 40B, best seen in FIG. 5. Guide track upper sections, 40A and 40B, are for guiding the binding wire around the wire core. Each binding wire guide track section, 40A and 40B, is comprised of a straight, vertical interior section disposed to descend, into the central, axial, open hole through the middle of the wire core. Binding wire guide track sections, 40, are aligned to descend between vertical components of carrying spool, 4, described in detail below. Preferably binding wire track sections, 40A and 40B, are further dimensional to extend below the bottom surface of the wire core, 2, and below the bottom stand and base of the wire core carrier, 4, upon full descent of compressor, 22. Preferably, the interior vertical section of binding wire guide track sections, 40A and 40B, are straight and the top portion is curvilinear, most preferably semicircular. However, any shape is equivalent provided the binding wire guide track sections redirect a progressing binding wire from a vertical direction on the outside of the wire core,2, to or from a vertical direction through the axial interior hole of the wire core, 2.

Also supported by frame, 20, is rotating tying head bracket, 24, best seen in FIGS. 1–4. The rotating tying head bracket's axis of rotation is coaxial with the wire core, 2, and carrying spool, 4. Support frame, 20, has a top central beam, 50. Substantially at the middle of beam, 50, is a pivot axis, 52, attached to beam, 50, and extending upwards therefrom into and through rotational fixation with the rotating tying head top bracket, 24. In the depicted embodiment rotating tying head top bracket, 24, is designed to rotate 90°. The top tying head bar, 24, is guided and supported through its rotation by arcuate guide rails, 56, which are fixedly attached to support frame, 20, at brackets, 58. Tying head top bar, 24, is capped at its ends with wheels or bosses, 60, in rotating or sliding communication with guide rails, 56.

Rotation actuator, 62, is pivotally affixed to top bracket, 24, at pivoting bracket, 64, and pivotally affixed to support frame, 20, at bracket, 66. Rotation actuator, 62, may extend and contract pneumatically, hydraulically or mechanically. Extension and retraction of rotation actuator, 62, swings the tying heads, 72, around the circumference of the wire core, 2, allowing the tying heads, 72, to move from a first position of engagement with first and second binding wire guide tracks, 40A and 16A, to a second position where tying heads, 72, come into engagement with a third and fourth binding wire guide tracks, 40B and 16B. Preferably, the four binding wire guide tracks are 90° from one another, although other numbers of guide tracks and angles between them are equivalent.

Fixedly attached to top tying head bar, 24, and hanging downward from it are two tying head anchor bars, 70. Fixedly attached to the vertical anchor bars, 70, are tying head assemblies, 72, shown in detail in FIG. 5. The tying head assembly, 72, is comprised of a binding wire propulsion electro-servo motor, 74, a knotter, 76, a knotter actuator electro-servo motor, 78 and drive wheels, (not shown) and a gripper and a cutter (within knotter 76). Tying heads incorporating electro-servo motors are preferred, and most preferred are tying heads actuated through electro-servo motors and controlled by programmable logic circuits. However, a variety of binding wire and binding strap propulsion, guiding and fastening mechanisms are known in the art. Any of these mechanisms incorporated into the apparatus herein described is considered to be within the scope of the present invention. The tying heads 72 are in their first position in FIG. 5.

Binding wire looping, tightening and knotting operates as follows. Upon being brought into operative communication with one another, the tying head assembly, 72, and guide tracks, 16A and 40A, describe a substantially complete loop in a single vertical plane. The loop circumscribes the object to be bound, in this case the wire core, 2.

Binding wire guide track sections, 16A and 40A, are all comprised of two longitudinal guide track halves extending for the length of the guide tracks. The guide track halves are biased together by any of a variety of equivalent biasing means, conventionally by springs 80 exerting inward tension, as seen in FIG. 6. On the internal faces of each wire guide track half, facing one another (not shown) are concave grooves which, while the guide track halves are biased together by the springs, form a channel for receiving and guiding advancing binding wire.

Once in place, binding wire propulsion electro-servo motor, 74, by means of drive wheels frictionally engaged with the binding wire (not shown) drives a length of the binding wire into and around the guide tracks, 16A, 16B, 40A and 40B. The pre-determined length of binding wire completes a loop around the wire core, 2. By means of, equivalently, a limit switch (not shown) or programmable logic circuit control measuring the distance of wire travel through the guide track, the propulsion motor stops when the binding wire has completed the loop around the wire core, 2. Upon completing this loop, a cutter (not shown) cuts the proximal end of the binding wire.

Upon completing its loop around the wire core, 2, a gripper (not shown) grips the distal end of the binding wire and holds it fast. Thereafter, propulsion electro-servo motor, 74, reverses the direction of the drive wheels (not shown) in order put tension on the binding wire. Since the wire, through the guide track, is disposed in a loop around the wire core, 2, the tension exerts an inward force on the wire in the wire guide track channel. The propulsion motor, 74 exerts a pre-configured degree of tension sufficient to overcome the strength of the biasing springs 80 holding the two binding wire guide track halves together. When this pre-determined amount of tension overcomes the inward biasing strength of the springs, 80, the binding wire is pulled from the guide track and free of it. Once the wire is free of the guide track, the propulsion servo motor, 74, continues to apply reversing tension until the binding wire comes into binding contact with the wire core, 2. Upon reaching a pre-configured tension, length, or other equivalent control means, the propulsion motor drive wheels (not shown) continue to exert a pre-determined torque on the binding wire, holding it in binding contact with the wire core. At this point the binding wire is ready to be knotted.

Thereafter a knotter, 76, is propelled by a knotter propulsion electro-servo motor, 78, through a pre-configured number of gear rotations to twist the ends of the binding wire together to form a knot.

It will be noted that in the depicted embodiment the four wire core binding wires are applied to the wire core in pairs, with one pair being parallel to the direction of the wire core's travel along the entry conveyor belt, 6, and the exit conveyor belt, 90. The other pair is perpendicular to the line of travel of the conveyor belts. In order to maintain an open passageway into the baling station, 10, for entry and exit of the wire core and carrying spool, the rest position of the tying head assembly, 72, is perpendicular to the conveyor belt line of travel, as in FIGS. 1, 2 and 3. This first position is also in operative alignment with the first pair of binding wire guide tracks 16A and 40A.

After depositing the wire core in the baling station, 10, the extendible conveyor belt arms, 8, are retracted. This allows space for rotation of the binding wire tying head bracket in an arc that will bring the tying head assembly, 72, into operative engagement with the binding wire guide tracks, 40B and 16B, corresponding to the pair that are parallel to the conveyor belt line of travel.

Figure 4:
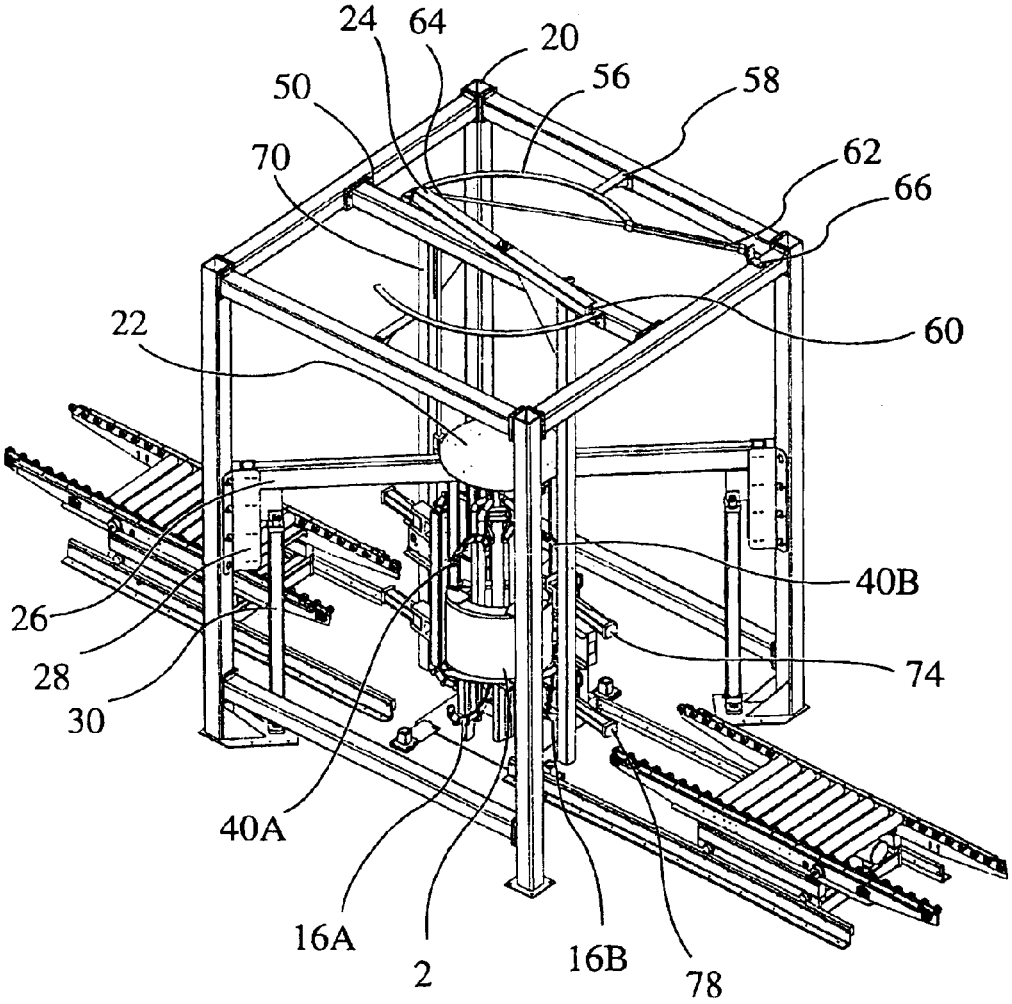
FIG. 4 is a perspective view of the wire core within the binding station with the tying heads engaged with the wire core in a second position.

Accordingly, after finishing the looping, tightening, cutting and tying of the first pair of binding wires around the wire core, the tying head bracket, 24, rotates (in this embodiment in a counterclockwise direction from a perspective above the apparatus) in order to swing the tying head assemblies, 72, into operative engagement with the second pair of binding wire guide tracks, 40B and 16B, at the second position as seen in FIG. 4. After reaching operating engagement with the second set of binding wire guide tracks 16B and 40B, the binding procedure for the second pair of binding wires is the same as that described for the first pair of binding wires, above. After the second pair of binding wires are looped, tightened, cut and knotted, the tying head bracket, 24, counter rotates (clockwise in this embodiment) back to its original position. Rotation of the tying head bracket, 24, is achieved by the action of rotation actuator arm, 62, which extends to push the top of bracket, 24, counterclockwise into its second position in alignment with the second pair of tying binding wire guide tracks, 40B and 16B. Thereafter rotation actuation arm, 62, retracts to pull the top of bracket, 24, clockwise back into the original position, which is also the rest position, aligned with tracks 16A and 40A.

After all four binding wires have been tightened and tied around the wire core, the compression apparatus, 22, is raised which allows wire core, 2, to naturally expand, which expansion is immediately arrested by the binding wires, which now hold the wire core in its preferred compressed volume and shape.

It will be noted that in order for the binding wire to come into binding contact with the wire core after its tensioning and release from the binding wire guide tracks, the binding wire must have a free path to the core uninterrupted by any pieces of the apparatus. Otherwise any intervening apparatus piece would be bound to the core and the core could not be withdrawn from the apparatus. The four compression arms, 32, and four compression plates, 34, are separate from one another to provide a clear path to the wire core for the binding wire. As the binding wire is tensioned and drawn tight against the wire core, it proceeds between each of the four compression plates, 34. Likewise, the binding wire is raised up through the table, 12, through the gaps 15 between the four quadrants 11 of the table's upper surface.

A novel aspect of the present invention is the design of the wire core collapsible carrying spool. It is integrated with the binding procedure and allows the wire core to be bound while on the carrying spool, having been previously deposited on the carrying spool. The collapsible carrying spool incorporates gaps in its two base layers, which gaps cooperatively align with the gaps in the top of the table, 12, and likewise allow passage therethrough of the binding wire in order that the binding wire directly contact the wire core, 2, without also binding in any unwanted apparatus, see FIGS. 7–11. The structure and the apparatus of the collapsible carrying spool are more fully described below.

After the binding wires have been tightened, knotted and cut, and after the tying head assemblies, 72, have rotated back to their rest positions perpendicular to the conveyor belts and after the compression apparatus, 22, has been lifted by extension of compressor apparatus lifting arms, 30, an exit path from the binding station, 10, is clear for removal of the wire core, 2, and collapsible carrying spool, 4. Accordingly, exit conveyor, 90, extends conveyor arms, 92, (see FIG. 3) into the binding station, 10, where they operatively engage with collapsible carrier spool, 4, in order to lift it from the binding table, 12, and withdraw it from the binding station, 10. Thereafter the combination of the bound wire core, 2, and collapsible carrying spool, 4, travel down exit conveyor, 90, to a position where they may be handled and transferred. This cycle repeats.

It will be evident to those of skill in the relevant arts that objects other than wire cores may be bound in the manner described herein without departing from the scope of the present invention.

COLLAPSIBLE CARRIER SPOOL

Figure 7:
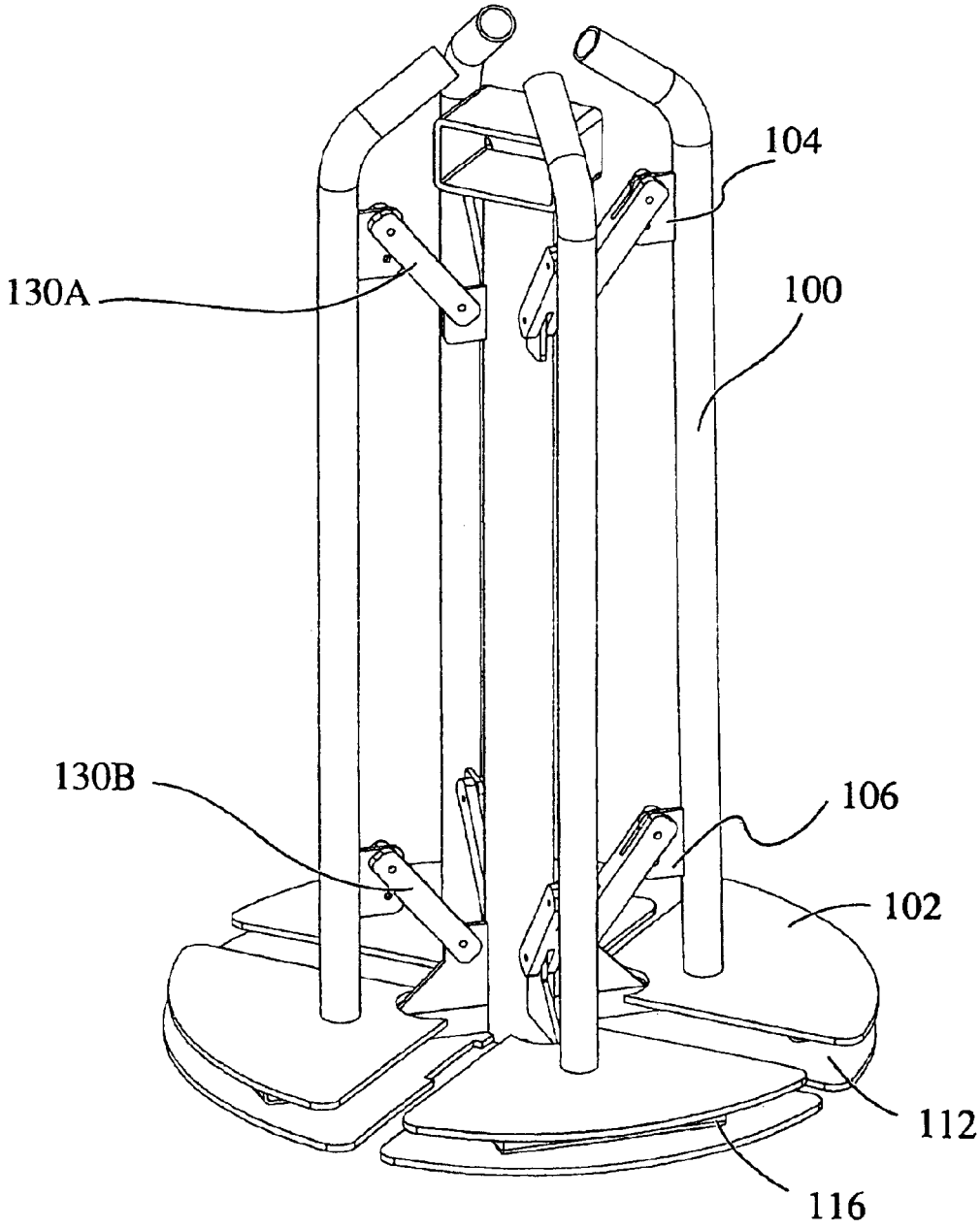
FIG. 7 depicts the integrated spool of the present invention.
Figure 9:
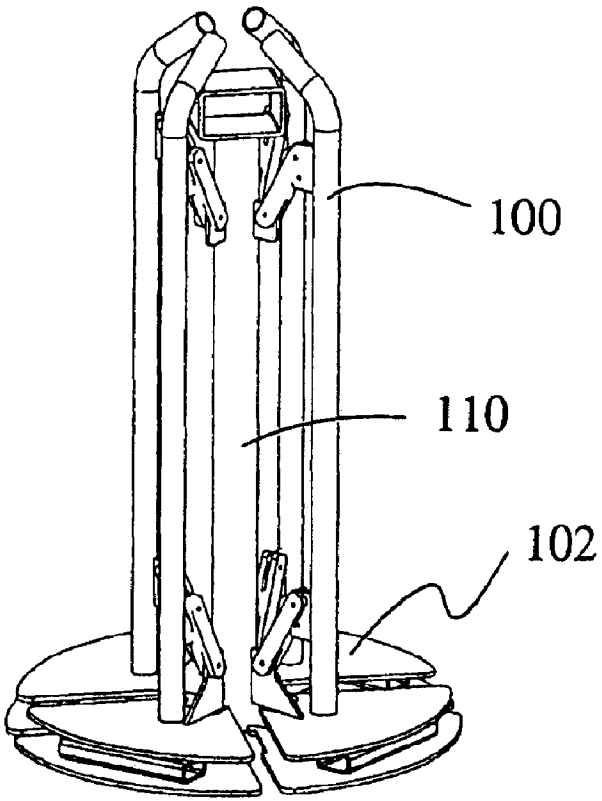
FIG. 9 is a depiction of the integrated core spool of the present invention in a collapsed position.
Figure 8:
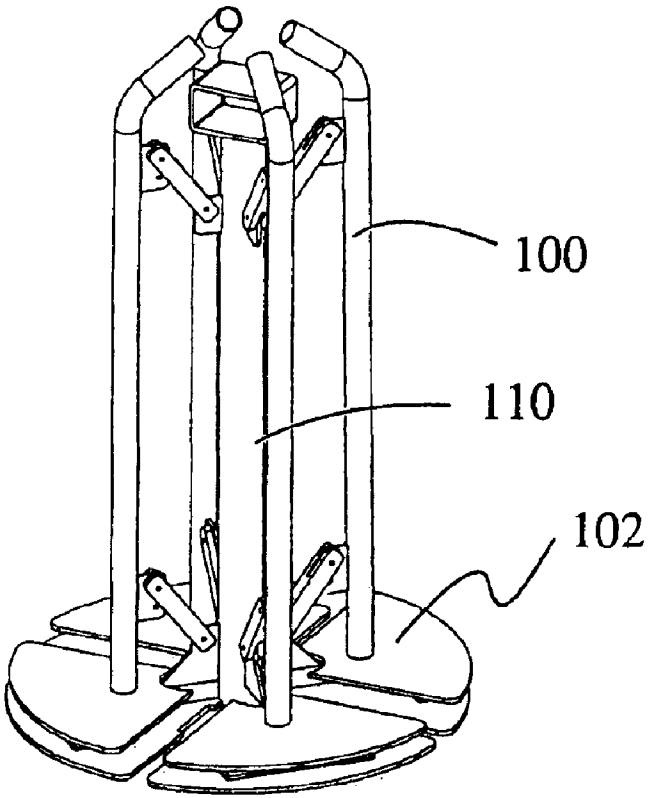
FIG. 8 is a depiction of the integrated carrying spool of the present invention in an expanded mode.

FIGS. 7–11 depicts the collapsible carrying spool of the present invention. It is expandable and contractible in a radial direction, as seen in FIGS. 8 and 9. In its expanded position, the spool tightens against the inside of the wire core for secure handling. In its contracted position the spool is easily removed from the wire core. The spool is also designed to cooperate with the compressing and binding apparatus during binding of the wire core, as previously described.

Figure 10:
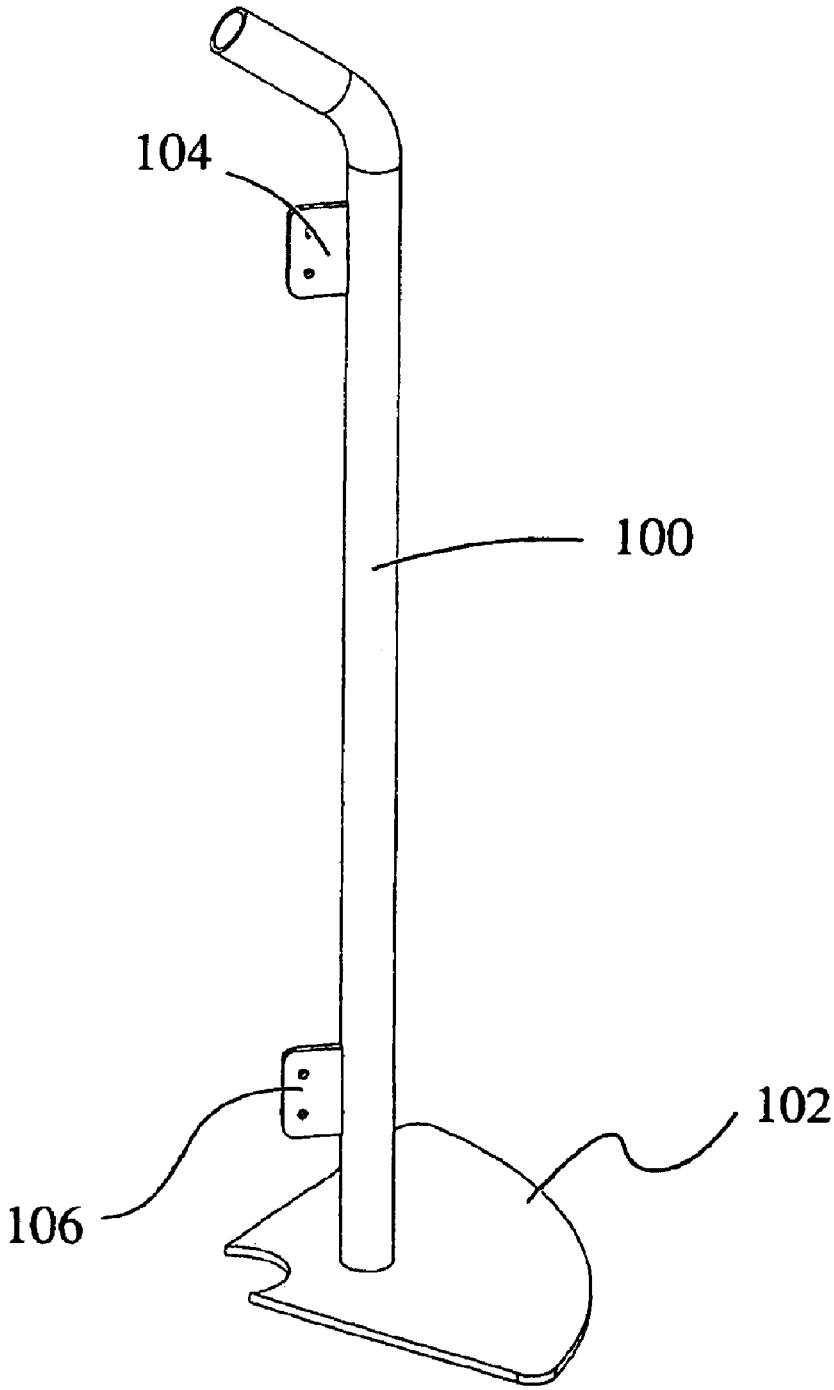
FIG. 10 is a depiction of a contact member of the spool of the present invention.

The collapsible carrying spool of the present invention is comprised of a plurality of contact members, 100, as individually seen in FIG. 10. In the herein described preferred embodiment, there are four contact members. Different numbers of contact members may be used. A vertical contact member is in the preferred embodiment a tube, although rods, bars, plates and the like may be used. Each vertical contact member, 100, is fixedly attached at its lower end to a base plate, 102. The base plate, 102, is wedge-shaped in the presently described preferred embodiment, the wedge corresponding to 90°. The base plate shape may equivalently be square or other shapes, provided that the assembled base plates have gaps between them for the binding wires to be drawn through while a wire core is on the spool and in the binding apparatus. The vertical contact member also has an upper boss, 104, and a lower boss, 106, on its inner aspect, each boss having a through hole. In the depicted preferred embodiment, an upper portion of the vertical contact member is angled inwards in order to prevent it catching on wire being placed on it or removed.

Figure 11:
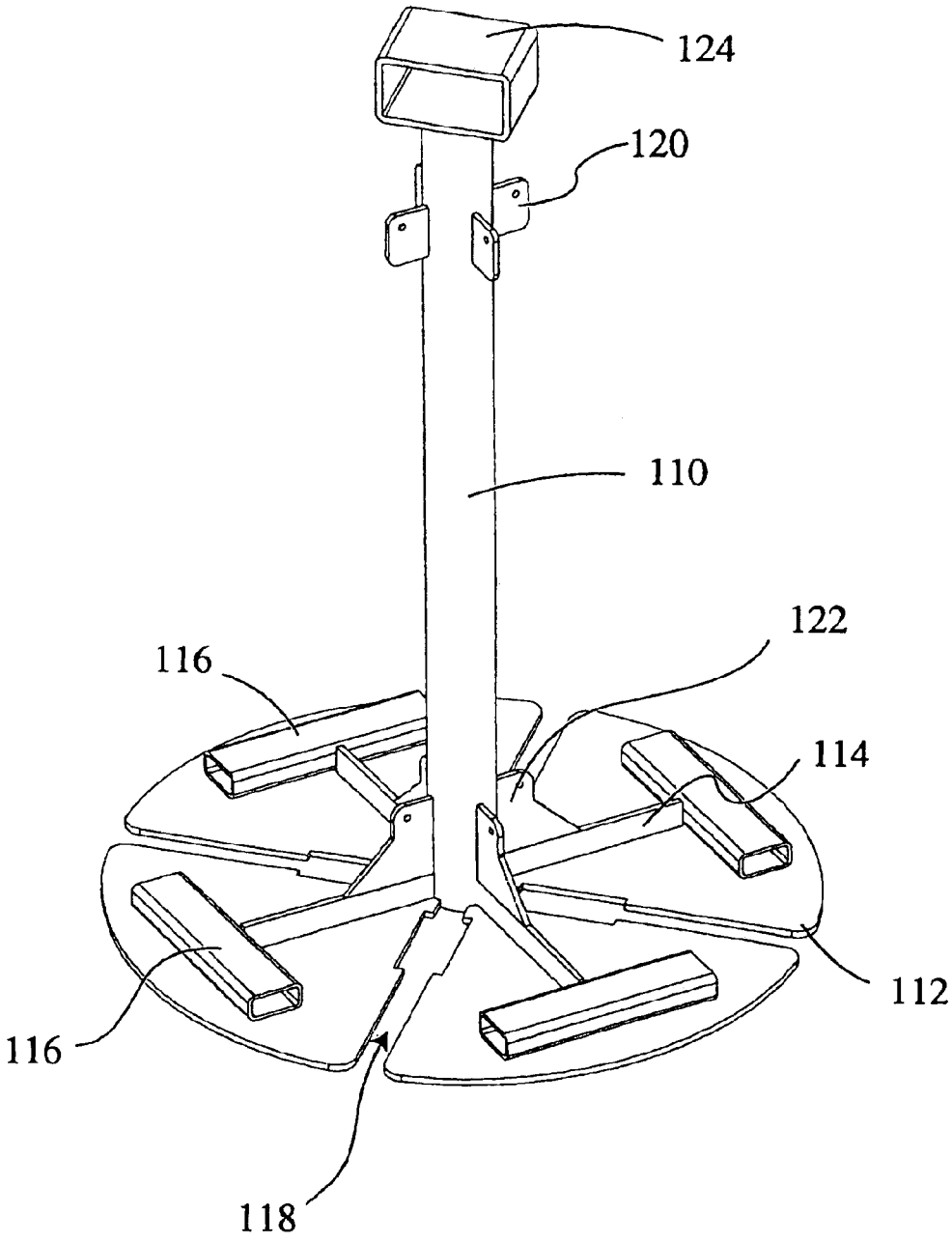
FIG. 11 is a depiction of the lower base member and axial lifting member of the wire core spool of the present invention.

FIG. 11 depicts the collapsible carrier spool central lifting member, 110, which is coaxial with the spool and the wire core. Fixedly attached to the bottom of the axial central lifting member, 110, are four wedge-shaped stands, 112. Radial supports, 114, attach and strengthen the union between the base stands, 112 and central lifting member, 110. Along with separators, 116, supports, 114, comprise a platform on which base plates, 102, may rest in one position while maintaining a gap between the base plates, 102, and stands, 112. Stands, 112, like the base plates, 102, are disposed such that a gap is maintained between adjacent stand members. The vertical contact members, 100, and their base plates, 102, will be disposed over the base stand members and in coordination with them such that the gaps between adjacent base plates, 102, and stands, 112, are parallel and aligned. The aligned gaps are a path through the spool for passage of a binding wire. In this manner, the gaps in the spool and table and the space between the compressor arms 32 form a path through the entire assembly through which a binding wire may be drawn tight against the wire core held by the spool. Gaps are apparent at 118. In a preferred embodiment these gaps are also wide enough to accommodate passage therethrough of binding wire guide tracks, 16A, 16B, 40A and 40B,. In the depicted embodiment, the gap widens near the axial central member 110 to accept insertion of the inboard guide tracks.

The central lifting member, 110, also has upper and lower bosses, 120 and 122, also each having through holes. The central axial member also has a handle, 124, for picking up the carrier spool and wire core with handling equipment such as fork trucks or lifting hooks.

Assembly of these components into the collapsible carrying spool is by means of eight expansion arms, seen in FIG. 7. Each of the eight expansion arms, 130A and 130B, are pivotally attached to the through holes in bosses, 104, 106, 120 and 122. Hence, the four upper expansion arms, 130A, have an inner end with a through hole pivotally attached to central lift member upper boss, 120, by means of a pin, bolt, rivet or other conventional pivoting fixation device. Each of the upper expansion arms, 130A, are also pivotally attached through similar pivoting fixation devices to the vertical contact member's upper bosses, 104. Similarly, lower expansion arms, 130B are pivotally connected at their inner end to axial lift member lower bosses, 122, and pivotally connected at their outer end to vertical expansion member lower bosses, 106.

The pivoting, actuate motion of the expansion arms, 130A and 130B, allow vertical contact members, 100, to move upwards and inwards in relation to central lifting member, 110, to reach a collapsed or contracted position. They also allow vertical members, 100, to move downward and outward in relation to central lifting member, 110, until their downward and outward motion is arrested by contact with supports, 114, and stops, 116, which is the expanded position.

It can be seen in FIGS. 8 and 9 that the upward motion of the vertical contact members, 100, moves the contact members, 100, closer together, narrowing their overall radius as a group and taking them out of contact with a wire core inner surface. In this position the spool is "collapsed," facilitating removal of the core from the spool. When the vertical contact members, 100, are moved in a downward motion, the outward arcuate motion of the expansion arms, 130, expand the overall radius of the group of vertical contact members, bringing each of them in contact with the inner surface of a wire core disposed on the spool. In this expanded position, the core is tightly secured to the spool during handling.

Outward expansion of the vertical contact members is actuated by the normal force of the wire core in a downward motion against the base plates, 102, in combination with an opposite upward force on the central lifting member, 110, which force is applied by any of a variety of handling machines such as fork trucks or lifting hooks, which are engaged by an operator with handle, 124. Hence a secure, tight engagement with the wire core carried by the spool is directly established by the act of lifting the spool.

Correspondingly, the spool may be "collapsed" by a downward force on the central lifting member, 110, or an upward lifting force on the base plates, 102, or a combination of the two. The base plates, 102, are separated vertically from the base stands, 112, a sufficient distance for the forks of a fork truck to be inserted therebetween, which presents another option for transporting the wire core/spool assembly, or for mounting the spool at a work station where the core will be used. Station forks or lifting forks exerting upward pressure on base plates 102 will narrow the contact members 100 and loosen the wire core from the spool.

In view of the foregoing, it will be seen that the several advantages of the invention are achieved and attained.

The embodiments were chosen and described in order to best explain the principles of the invention and its practical application to thereby enable others skilled in the art to best utilize the invention and various embodiments and with various modifications as are suited to the particular use contemplated.

As various modifications could be made in the constructions and method herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed:

1. A spool comprising:

an axial member;

at least two expandable members hingedly connected to said axial member, said expandable members having an expanded position that contacts a wire core and said expandable members having a contracted position out of contact with the wire core;

a stand fixed to the bottom of said axial member; and a base fixed to the bottom of each of said expandable members, wherein said stand and said base comprise a plurality of gaps between a plurality of stand sections and a plurality of base sections, respectively, and wherein said plurality of gaps align with corresponding gaps in sections of a binding table.

2. The spool of claim 1, wherein said stand sections are located beneath said base sections.

3. The spool of claim 1 further comprising:

four expandable members, said expandable members being vertical and said expandable members radially surrounding said axial member; and a handle attached to the top of said axial member.

4. The spool of claim 1 further comprising a plurality of spacers axially spacing said base sections from said stand sections, wherein said stand supports said base.

5. The spool of claim 1 wherein said bases and said stand are separated by a spacer.

6. The spool of claim 1, wherein said spacing of said stand sections extend from said axial member radially past said expandable members.

7. The spool of claim 1 wherein said stand has at least one locator pin.

8. The spool of claim 7 wherein said at least one locator pin is moveable between a retracted position and an extended position, said extended position being adapted to engage at least one locator pin receptacle.

9. The spool of claim 8 wherein said at least one locator pin is biased towards said extended position.

10. The spool of claim 1 wherein said stand has at least one receptacle that receives a locator pin.

11. A wire core spool comprising:

an axial lifting member having a plurality of bosses disposed in longitudinal pairs along said axial lifting member;

a plurality of expansion arms, each of said arms having an inner end and an outer end and each of said inner ends being pivotally attached to one of said axial lifting member;

a plurality of contact members, each having a top end and a bottom end and each having a substantially inner face and a substantially outer face, each of said innerfaces having at least a pair of bosses pivotally attached to said outer ends of said expansion arms and each of said outer faces disposed to contact an inner surface of a wire core upon radial expansion of said contact members, actuated through pivotal motion of said expansion arms;

a plurality of base members, each of said base members being attached to said bottom ends of said contact members, and each of said base members being disposed to contact a bottom surface of the wire core and support the wire core's weight and each of said base members being disposed in a spaced relation to adjacent base members; and at least one stand section attached to a bottom end of said axial lifting member, said at least one stand section defining at least one spaced relation, and said at least one stand section being disposed such that said base members rest on top of said at least one stand section upon said radial expansion of said contact members.

12. The spool of claim 11 further comprising:

at least two of said base members have substantially straight external edges that are substantially parallel, said substantially straight external edges being in preconfigured relation to internal edges of said base members that define said spaced relation of said adjacent base members;

said at least one stand section having at least two substantially straight external edges that are substantially parallel, said at least two substantially straight external edges being in preconfigured relation to internal edges of said least one stand section that define said spaced relation of said at least one stand section; and said substantially straight external edges of said base members and said substantially straight external edges of said at least one stand section being dimensioned to fit in close sliding cooperation with side walls of an entry conveyor;

whereby said spaced relations are alignable with spaced relations between sections of a binding table.

13. The spool of claim 12 wherein said substantially straight external edges of said base members and said substantially straight external edges of said at least one stand section are perpendicular to at least one of said internal edges of said base members and to at least one of said internal edges of said at least one stand section, whereby said spaced relations are alignable with spaced relations between sections of a binding table.

14. The spool of claim 12 wherein said substantially straight external edges of said base members and said substantially straight external edges of said at least one stand section are parallel to at least one of said internal edges of said base members and to at least one of said internal edges of said at least one stand section, whereby said spaced relations are alignable with spaced relations between sections of a binding table.

15. The spool of claim 12 wherein said substantially straight external edges of said base members and said substantially straight external edges of said at least one stand section are dimensioned to fit in close sliding cooperation with side walls of a binding table to align said spaced relations of said base members and said spaced relations of said at least one stand section with said spaced relations of said sections of said binding table.

16. A method of spooling a wire core comprising:

disposing a wire core on a spool, said spool comprising a central lifting element having a top end and a bottom end, said top end having a handle and said bottom end being fixedly attached to at least one stand element;

attaching at least one of a plurality of contact elements, at a bottom end to a base element, each of said contact elements being attached to said central lifting element such that said contact elements expand radially outward from said central lifting element upon lifting of said central lifting element and such that said contact elements move inward. towards said central lifting element upon lifting of said base elements; and resting said base elements on said stand elements when said contact elements are in said expanded position.

17. A spool for a binding table having at least one binding table gap, comprising:

an axial member;

a plurality of contact members hinged connected to said axial member, a stand fixed to the bottom of said axial member, wherein said stand extends in a plurality of wedge-shaped sections from said axial member radicially past said contact members; and a base fixed to the bottom of each of said members, wherein said stan is located beneath said bases.

18. The spool of claim 17 further comprising a spacer located between said stand and said base.

19. The spool of claim 17 further comprising a plurality of gaps, a plurality of stand sections and a plurality of base sections, wherein each of said gaps is an axially spaced gap pair between said stand sections and said base sections, and wherein each of said gaps in said gap pair are mutually aligned with each other.

20. The spool of claim 19 further comprising a plurality of locator pins, wherein at least one of said locator pins aligns at least one axially spaced gap pair with the binding table gap, and wherein another one of said locator pins is offset and aligns another corresponding binding table gap.

* * * * *

UNITED STATES PATENT AND TRADEMARK OFFICE

CERTIFICATE OF CORRECTION

PATENT NO. : 6,935,665 B2
DATED : August 30, 2005
INVENTOR(S) : Jones et al.

It is certified that error appears in the above-identified patent and that said Letters Patent is hereby corrected as shown below:

Column 10,
Line 17, reads “wherein said spacing of said stand” should read -- wherein said stand --.
Line 37, reads “said axial lifting” should read -- said bosses on said axial lifting --.
Line 41, reads “each of said innerfaces” should read -- each of said inner faces --.

Column 12,
Line 17, reads “members hinged connected” should read -- members hingedly connected --.
Line 21, reads “member radically past” should read -- member radially past --.
Line 23, reads “each of said members” should read -- each of said contact members --.
Line 24, reads “wherein said stan is” should read -- wherein said stand is --.

Signed and Sealed this

First Day of November, 2005

JON W. DUDAS
*Director of the United States Patent and Trademark Office*